United States Patent [19]

Thompson et al.

[11] Patent Number: 4,550,670

[45] Date of Patent: Nov. 5, 1985

[54] MATERIAL HANDLING SYSTEM

[75] Inventors: Kenneth J. Thompson, Lexington; Joel C. Rosenquist, Kernersville; Wayne G. Foster, Advance, all of N.C.

[73] Assignee: Consolidated Foods Corporation, Winston-Salem, N.C.

[21] Appl. No.: 457,457

[22] Filed: Jan. 12, 1983

[51] Int. Cl.[4] ..... D05B 19/00

[52] U.S. Cl. ..... 112/121.11; 112/121.29; 112/130; 112/147

[58] Field of Search ..... 112/121.29, 121.11, 112/121.12, 130, 147, 141, 121.15

[56] References Cited

U.S. PATENT DOCUMENTS

| | | | |
|---|---|---|---|
| 2,370,311 | 2/1945 | Hercik | 83/601 |
| 3,515,081 | 6/1970 | Miller | 112/130 |
| 3,695,195 | 10/1972 | Frost | 112/121.29 |
| 3,736,895 | 6/1973 | Farrar et al. | 112/147 |
| 3,933,105 | 1/1976 | Frost et al. | 112/121.29 X |
| 3,973,506 | 8/1976 | Rinehimer et al. | 112/130 |
| 4,095,537 | 6/1978 | Silverman et al. | 112/121.29 |
| 4,204,492 | 5/1980 | Blessing | 112/121.12 X |
| 4,281,607 | 8/1981 | Torre | 112/130 |

*Primary Examiner*—H. Hampton Hunter

*Attorney, Agent, or Firm*—Charles Y. Lackey; William S. Burden

[57] ABSTRACT

A material handling system includes an assembly for feeding, directing and sewing fabric materials, an assembly for cutting fabric, and an assembly for stacking fabric. The feeding and sewing assembly folds a reinforcing binding web over the edge of a garment panel and sews the two together before they are advanced by the binding to the cutter assembly. The cutting assembly includes angularly disposed blades for simultaneously severing the binding web intermediate adjacent garment panels. The stacking assembly includes a conveyor for sequentially advancing severed garment panels to an elevator mechanism for receiving the panels.

8 Claims, 13 Drawing Figures

MATERIAL HANDLING SYSTEM

This invention relates generally to a material handling system, and more particularly to apparatus for guiding, aligning, feeding, sewing, cutting and stacking garment components.

Although the invention will be described in conjunction with the application of a reinforcing binding fabric to precut fabric panels used in the fabrication of briefs, the basic concepts are susceptible to other uses wherein a first fabric-like material is directed in a prescribed manner while a second fabric-like material is sewn thereto.

Briefly, the invention includes an assembly for directing and sewing fabric materials, an assembly for cutting fabric, and an assembly for stacking the fabric materials.

The assembly for directing and sewing fabric materials folds a first binding web, which serves as a reinforcing member, over the edge of a garment panel or component before being selectively secured together in a predetermined fashion by sewing instrumentalities. The assembly includes various mechanisms for straightening and feeding the fabric materials to the cutter assembly. A series of panels are sequentially advanced by an operator to the sewing instrumentalities of a conventional sewing machine where they are sewed to the binding web and carried by the binding towards the cutting assembly.

The cutting or chopper assembly is mounted downstream of the machine's sewing zone and includes angularly disposed chopper blades attached to a linkage and controlled by a fluid operated actuator. Upon receipt of a single signal the actuator displaces the linkage in a first direction to move the chopper blades from a rest position to a cutting position, and back to the rest position. The cutter assembly serves to cut the binding intermediate to adjacent garment panels sewn to and being advanced by the fabric binding. The discrete garment components, each consisting of a panel sewn to a binding, are sequentially advanced to the stacking assembly.

The stacking assembly includes a conveyor for sequentially advancing the discrete components to a drop plate. The drop plate is selectively displaced for discharging each component onto a stack tray. The stack tray position below the drop plate is controlled by an elevator mechanism.

One of the primary objects of the invention is the provision of a new and improved system for sewing fabric panels to a fabric reinforcing member, severing the reinforcing member intermediate the panels to define discrete fabric components, and stacking of the components in a prescribed manner.

Another object of the invention is the provision of a new and improved system for increasing production while reducing the skill required to operate the apparatus for sewing the fabric materials.

A further object of the invention is the provision of a chopper assembly having plural, angularly disposed cutting edges for simultaneously severing portions of the reinforcing member.

Still another object of the invention is the provision of a new and improved garment component stacking assembly.

These and other objects of the invention will become more fully apparent by reference to the appended claims and as the following detailed description proceeds in reference to the figures of the drawing.

DETAILED DESCRIPTION OF THE INVENTION

Figure 1:
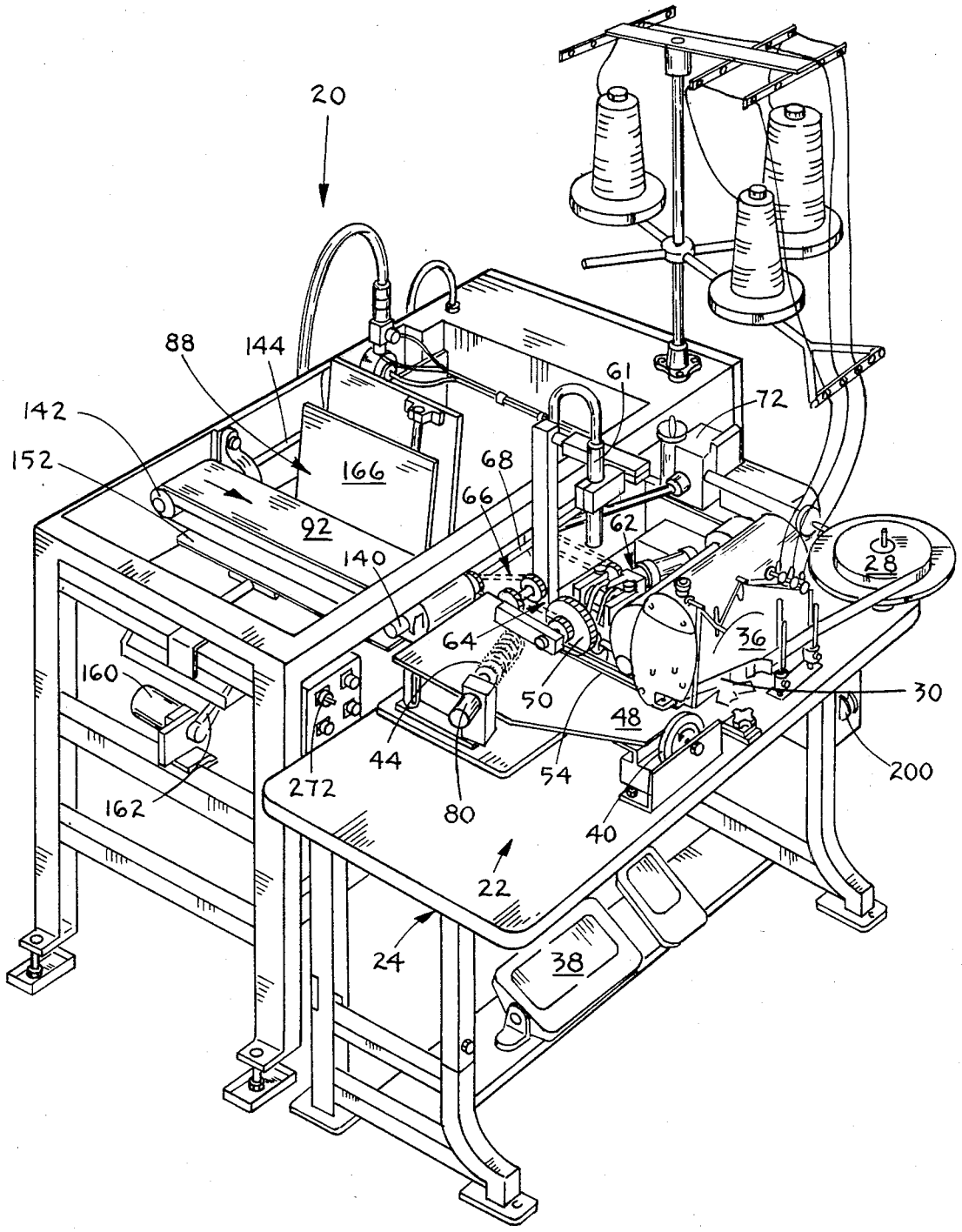
FIG. 1 is a schematic perspective view of a portion of the system for sewing and stacking garment components.

Referring to the drawing, and particularly to FIG. 1, the apparatus 20 includes a guiding, aligning, feeding and sewing system 22 mounted upon a support structure 24 for the joining of fabric panels 26 to reinforcing binding fabric 28.

The apparatus incorporates a conventional folding and guiding device 30 for folding a continuous supply of binding fabric 28 into a predetermined relationship prior to the binding reaching the sewing instrumentalities 32 and presser foot 34 of a conventional sewing machine 36. The binding 28 moving through device 30 is fed under the presser foot 34 of the sewing machine as long as the sewing machine is in operation. When an operator properly aligns a fabric panel 26 in close proximity to the sewing instrumentalities 32 and binding 28, and activates the sewing machine by means of a foot treadle 38 or other suitable means, the panel 26 and binding 28 will move in unison and be sewn together.

Depressing the machine foot treadle simultaneously initiates several other machine functions. The cloth straightener wheel 40 begins to rotate in a counterclockwise direction, as viewed from the front of the machine, air is discharged through a small air jet 42, the cloth brush 44 begins to rotate, a vacuum source 43 is activated to remove any binding waste material through opening 46 in the cloth plate 48, and the cloth wheel 50, the binding wheel 52, and the binding drive belt 54 are activated. The air jet opening 42 is angled downwardly to direct air against panel 26 and urge it downwardly while straightening the portion remote to binding 28.

As the operator guides a fabric panel 26 into alignment with the binding 28 and toward the sewing instrumentalities, the cloth straightener wheel 40, which may be provided with soft bristles, rotates in a direction which tends to urge the panel away from the binding thus straightening and removing wrinkles from the panel 26. The wheel 40 may be driven in a conventional manner by a motor 41 located below plate 48.

Figure 4:
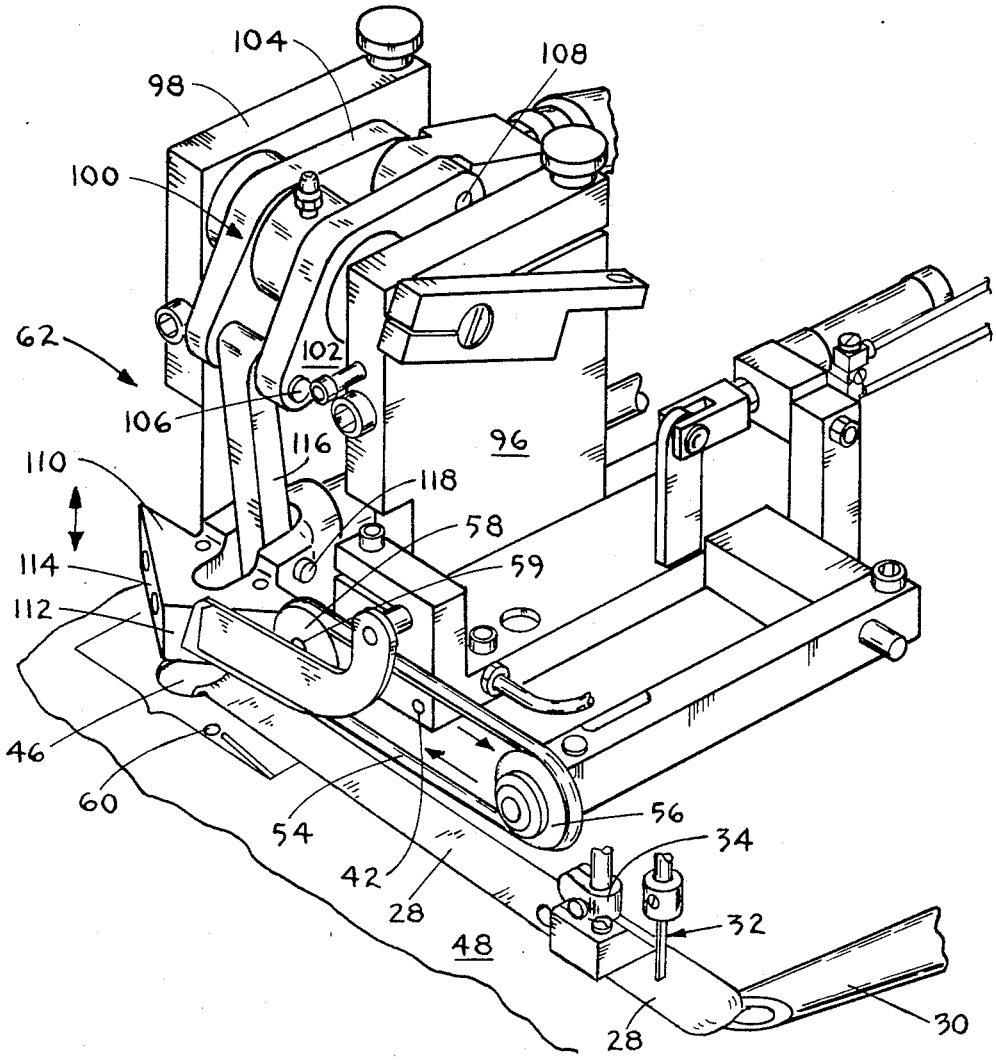
FIG. 4 is an enlarged perspective view of a portion of the machine illustrating the cutter or chopper assembly and the binding drive belt.

The binding drive belt 54 extends around two pulleys or rollers 56, 58, FIG. 4, and is driven from the sewing machine motor 55 by means of shaft 79, belt 73 and pulleys 75, 77, drive unit 72, and shaft 57 which is connected by a coupling, not shown, to shaft 59 supporting the pulley 58.

The binding drive belt 54 conveys the binding as it leaves the sewing machine presser foot 34 and the loose forward end of the binding is drawn by suction into the waste opening 46 in the plate 48 and subsequently to a waste receptacle, not shown. As a panel 26 is sewn into the binding 28, it slides upon plate 48 as it is carried along by the binding 28. The leading edge of the panel 26 is blown aside by the small air jet 42 just as it goes under the driven cloth wheel 50. Thus a portion of the panel 26 is attached to the binder and is being advanced by drive belt 54, while a portion is being advanced by cloth wheel 50. The leading edge of the panel 26 intermediate belt 54 and wheel 50 is positioned to activate a photoelectric sensor 60, FIG. 4, which functions to operate a cutting or chopper assembly 62, and to deactivate the vacuum source which normally draws the waste binding into opening 46 as it will be subsequently described.

The cloth wheel 50 is positioned to normally substantially engage the cloth plate 48 and is driven by means of chain and sprocket drive assemblies 64, 66, drive shafts 68, 70, drive unit 72, belt 73 and pulleys 75, 77, and shaft 79 connected to the sewing machine motor 55.

The panel 26 attached to the binding 28 is also advanced by cloth brush 44 which is driven by motor 80. Note that the brush 44 is supported for rotation in bearing blocks and is angularly disposed, with respect to the direction of movement of the panel and binding through the machine, urging the panel in a direction away from the binding to facilitate removal of wrinkles from the panel and flattening of the panel upon plate 48.

The binding wheel 52 is driven from shaft 68 by means of sprocket drive assembly 82 and shaft 84 and advances the binding 28 and panel 26 attached thereto towards the stacking assembly 88. The binding wheel 52 applies tension to the binding 28 extending between wheel 52 and the binding drive belt 54 to assist in cutting of the binding upon activation of the chopper assembly 62. After the binding 28 has been severed, the garment component 90, which consists of a fabric panel 26 attached to a severed length of binding 28, is fed by the binding wheel 52 until the leading edge goes under the stacking assembly conveyor belt 92.

Figure 6:
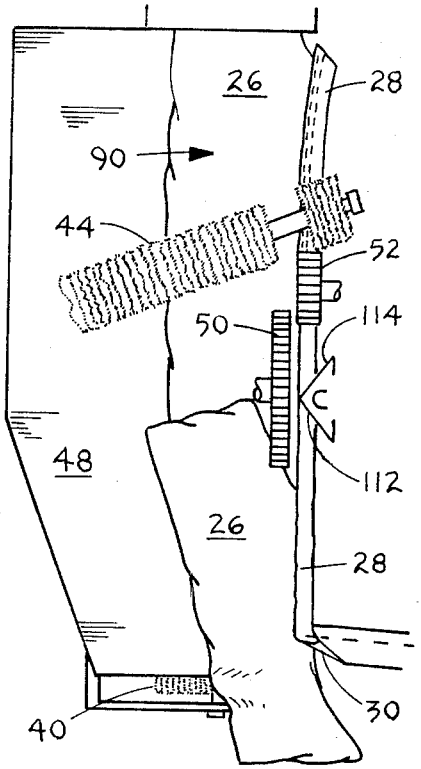
FIG. 6 is a fragmentary, top elevational view of the apparatus illustrating the relationship of a panel with respect to the binding, and the various mechanisms for aligning, guiding and advancing the panels.

Referring particularly to FIGS. 4–6, the chopper assembly 62 provides a novel, instantaneous, double angle cut of the binding 28. The angle of cut of leading and trailing edges of a length of binding sewn to a panel 26 serves to taper the end portions of the binding into the panel edge thus eliminating unevenness and bulkiness of the garment components adjacent the ends of the binding 28 which results in improved appearance and comfort to a wearer. As shown by FIG. 6, the two cutting blades define an angle of approximately 90° such that the angle of cut of the binding adjacent the leading edge of a panel is angled approximately 45° in one direction while the end of the binding adjacent the trailing end of the panel is angled approximately 45° in the opposite direction. The assembly includes spaced parallel supports 96, 98 which pivotably mount, in suitable bearings, pivot pin 99 which has a linkage 100 mounted thereon. The linkage includes a pair of spaced, parallel members 102, 104 having aligned openings adjacent each other for receiving pins 106, 108.

The blade support 110 is movable along vertical guideways of the supports 96, 98 such that each angularly disposed blade 122, 114 secured thereto is capable of displacement in a vertical plane while the lower cutting edges of each blade remain parallel with the upper surface of cloth plate 48. The blades are displaceable by means of a bar or link 116 pivotably coupled at one end to the blade support 110 by means of a pin 118, and pivotably coupled at the opposite end, by pin 106, to the linkage 100. The rod 120 of a double acting fluid cylinder 122 is pivotably coupled to the linkage 100 by means of pin 108.

Figure 5A:
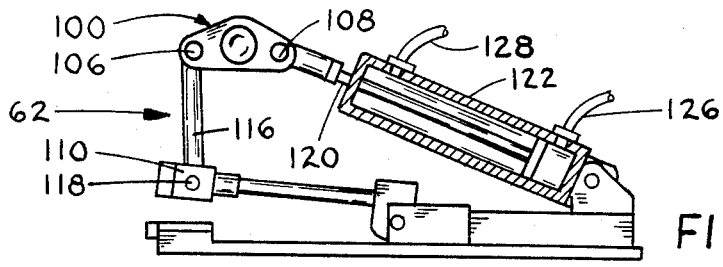
FIGS. 5*a*–5*c* are schematic side elevational views of the chopper assembly, partly in section, illustrating displacement of the blades during one stroke of the fluid cylinder.
Figure 5B:
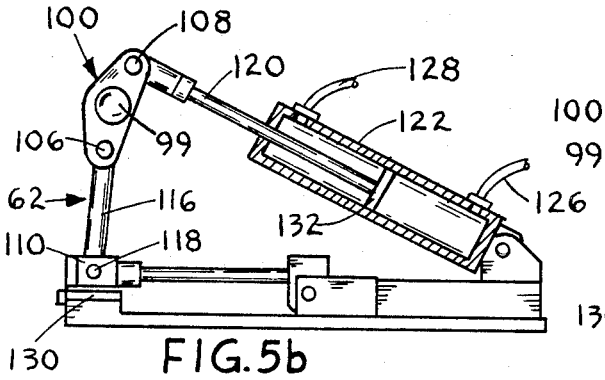
Figure 5C:
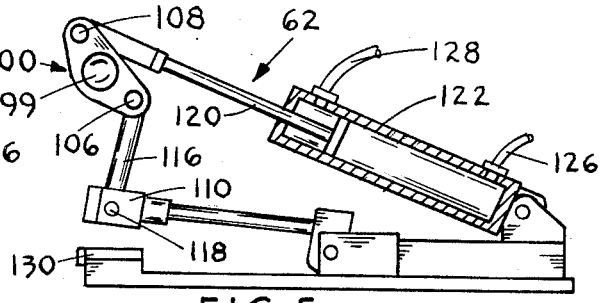

The chopper assembly performs two double angled cuts through binding 28 for each cycle of the fluid cylinder 122. Referring to FIG. 5*a*, the blades and blade support 110 are in the full up position and the rod is attracted within the cylinder. Upon the continuous admission of fluid into the cylinder 122 through conduit 126, the rod 120 begins moving to the left, FIG. 5*b*, and the blades 112, 114 are displaced vertically downwardly into engagement with a block member 130 of nylon or other suitable material having an upper surface flush with the polished cloth plate 48. Any binder fabric 28 located below the blades would be severed along two angularly disposed lines. Note that at this point the piston 132 attached to rod 120 is approximately midway of the length of the cylinder housing. As fluid continues to be admitted through conduit 126, the piston rod 120 moves further to the left, FIG. 5*c*, and pin 108 pivots over the top center of pin 99 and the blades and support 110 move back to the uppermost position. Note that the blades move from a retracted position into cutting engagement with the nylon member 130 and again back to a retracted position during one stroke of the piston and piston rod. Another complete chopping action is achieved as fluid is admitted into cylinder 122 through conduit 128 and the piston and piston rod 120, 132 move to the right, FIGS. 5*c*, 5*b*, 5*a*.

Reciprocation of the chopper blades could alternately be accomplished by means of a rotary fluid cylinder, if desired.

Once the binding has been severed by the chopper assembly, the garment component 90 consisting of the severed length of binding and a fabric panel 26 having an inwardly curved edge is advanced by the binding wheel 52 to the stack conveyor belt 92.

The conveyor belt 92 passes around rollers 140 and 142 mounted upon shafts 68 and 144, respectively. The belt 92 normally is driven from the sewing machine motor at a speed comparable to that of binding wheel 52 and cloth wheel 50. When a component 90 starts into position between the lower run of belt 92 and the drop plate 152 the conveyor belt must speed up to rapidly position the component over the drop plate in order for the drop plate to deposit the component upon stack tray 166 and complete its operational cycle before a subsequent component 90 is advanced to the belt 92. In order to permit the increase in speed of belt 92, conventional one-way clutches 138 are provided intermediate belt roller 140 and shaft 68. Shaft 144 supporting roller 142 is driven only when the conveyor speed is to be increased. The shaft 146 is selectively driven upon actuation of fluid cylinder 151 through pulleys 148, 150 and belt 146. This increase in speed, permitted by the one-way clutches, is necessary in order to permit the stacking assembly to stack the component and for the drop plate 152 to move back to its original position for receiving a subsequent component.

The drop plate 152 mounted generally parallel to and in close proximity to the lower rung of conveyor belt 92 is pivotably coupled to the upper ends of parallel lengths 154, 156 by a pin 158. The lower ends of the lengths 154, 156 are pivotably mounted upon the frame 24.

Reciprocation of the drop plate 152 is accomplished by a fluid motor 160 which drives an eccentrically mounted arm 162 connected to the lengths 154, 156 by an adjustable linkage 164. When the motor 160 and linkage begin retracting the drop plate 152 to the right, FIG. 3, the panel drops onto the stack tray 166. After a predetermined time period, the drop plate returns to its original FIG. 3 position. The stacking assembly is now ready to receive the next component 90.

Figure 7:
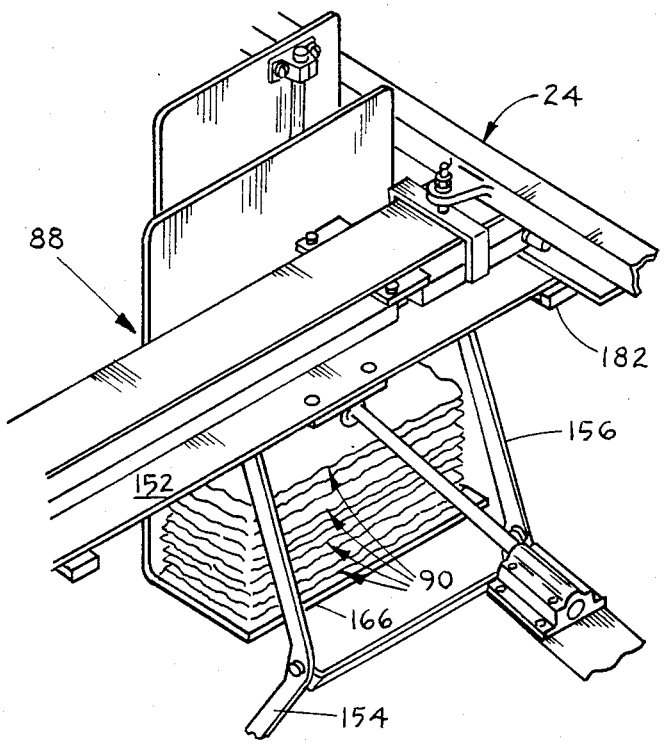
FIG. 7 is a schematic, fragmentary, perspective view of the apparatus illustrating the stacking assembly conveyor, drop plate and stack tray.
Figure 2:
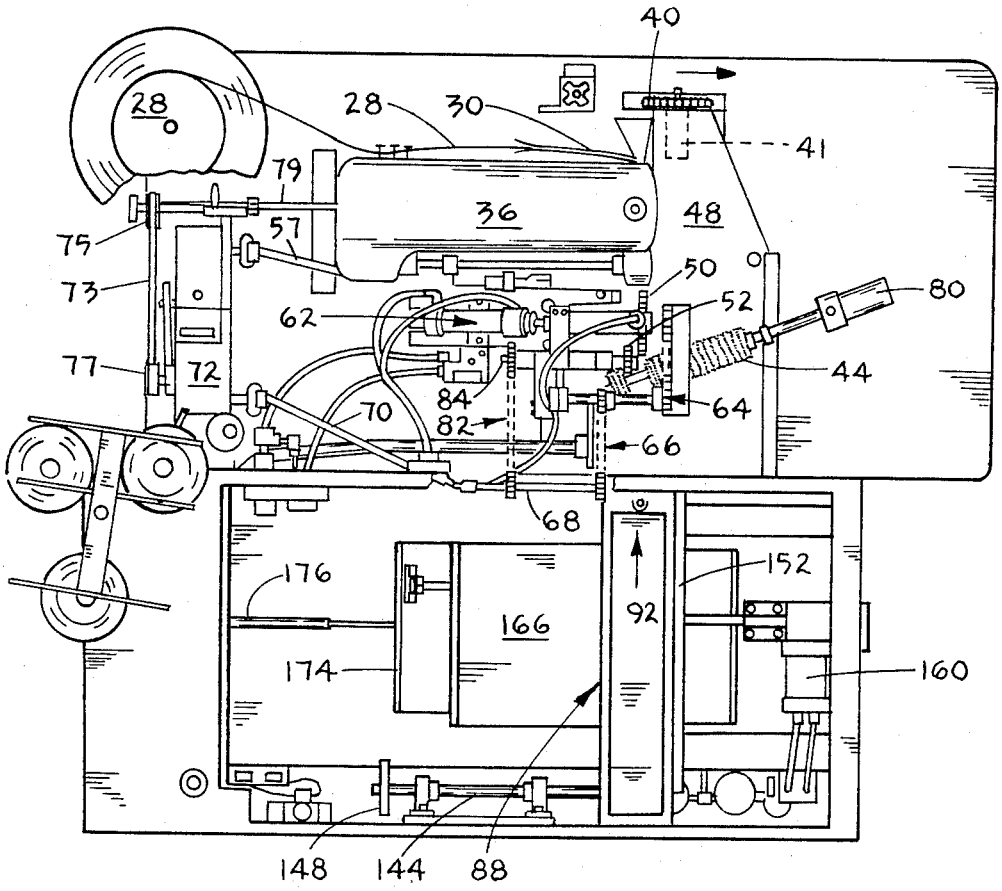
FIG. 2 is a schematic top plan view of the apparatus of FIG. 1.

The position of the stack tray 166 is controlled by an elevator mechanism which includes a double acting fluid cylinder 170. In order to eliminate wrinkling or uneven stacking of the garment components 90 upon tray 166, the tray or uppermost component of a stack of components should be located in close proximity to the drop plate 152, when the plate 152 is in the FIG. 3 or FIG. 7 positions, so that a component can be properly positioned upon the stack as the drop tray is retracted to the right, FIG. 3, and a component 90 is released. As the stack of components gets higher, the tray lowers to keep the top of the stack in about the same position. The stack tray 166 is attached to the rod 172 of fluid cylinder 170 and mounted upon a frame assembly 174 for vertical displacement upon movement of the rod of the cylinder. The cylinder 170 is mounted upon frame assembly 174, the lower end of which is pivotably mounted upon support structure 24. During the formation of a stack of components, the frame assembly 174 normally is in the FIG. 3 position; however, when a full stack of components 90 have been stacked upon the tray 166, an air cylinder 176 may be operated to tilt the frame assembly 174 to the left, from the FIG. 3 position, about the pivotably mounted lower end, to provide operator access to the loaded tray 166 and facilitate removal of the stacked components. FIG. 2 shows a tray 166 and frame 174 tilted to provide access to the tray. Also mounted upon the tiltable frame 174 are a pair of air-oil tanks 254, 256, one being in series with each port of the double acting cylinder 170.

The top of the stack of components 90 is sensed by a photoelectric mechanism 182 secured to the support structure 24 just below the drop plate 152. The photoelectric sensor controls the location of the top of the stack of components through the air-oil tanks and cylinder 170, as will be subsequently described.

The operation of the system will now be described. An operator actuates a manual switch 200 which turns on the sewing machine motor 55. The operator then properly positions and aligns a panel 26 in front of the sewing instrumentalities of the sewing machine using both hands. Depressing the treadle 38 operates the sewing machine motor clutch 202 which initiates operation of the sewing machine instrumentalities 32. The clutch also simultaneously activates a microswitch 204 which, in turn, activates the brush motor 80, brush motor 41, a solenoid valve 206 which permits the discharge of air from jet 42, and a valve 208 which controls vacuum source 43 which draws any waste material through opening 46 in the cloth plate 48. Actuation of the clutch 202 also drives the binding drive belt 54, the binding wheel 52, the cloth wheel 50 and the conveyor belt 92 through the various pulleys, belts and shafts previously described. The operator then feeds the panel to the sewing instrumentalities and guides the panel with his right hand while at the same time rotation of the cloth straightener wheel 40 straightens the wrinkles in the panel.

The binding drive belt 54 applies downward pressure to the binding 28 sliding along polished plate 48 as the binding leaves the presser foot, and the loose forward end of the binding is drawn through waste takeaway opening 46 by the vacuum source 43. As the panel 26 is sewn to the folded binding 28 it is carried along by the binding.

Figure 8:
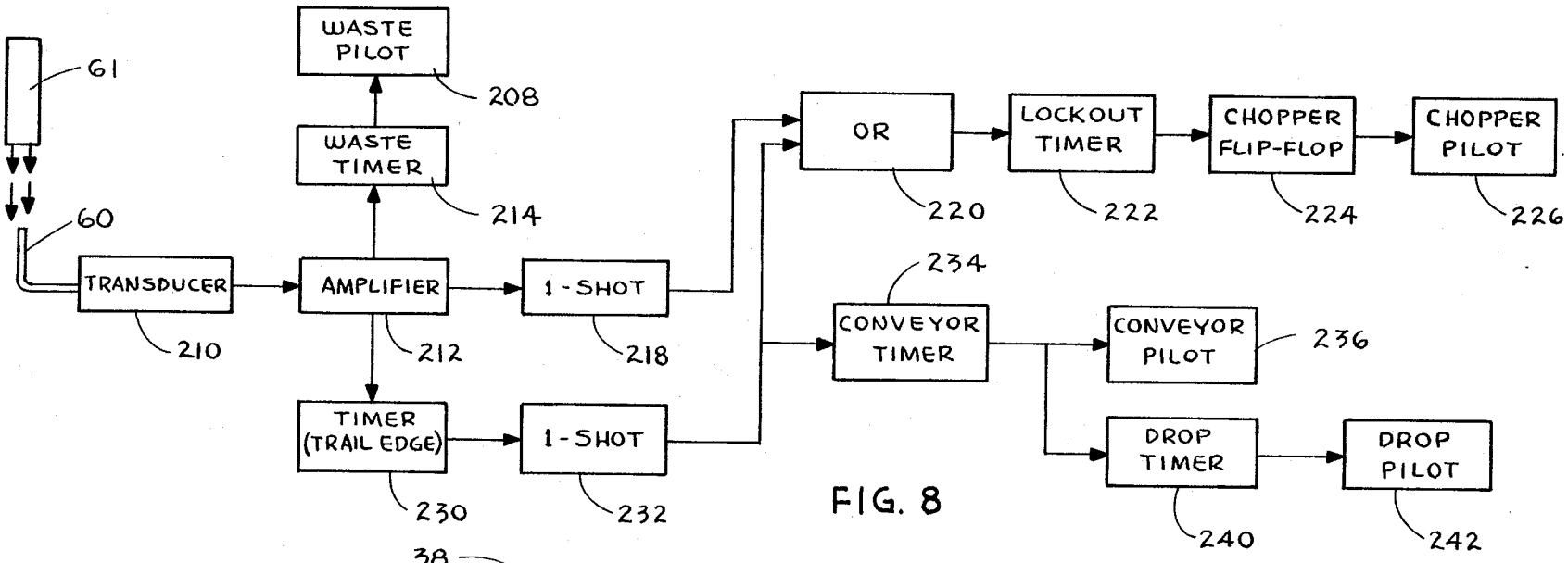
FIG. 8 is a schematic diagram of the controls for the chopper assembly and the stacking conveyor belt and drop plate.
Figure 10:
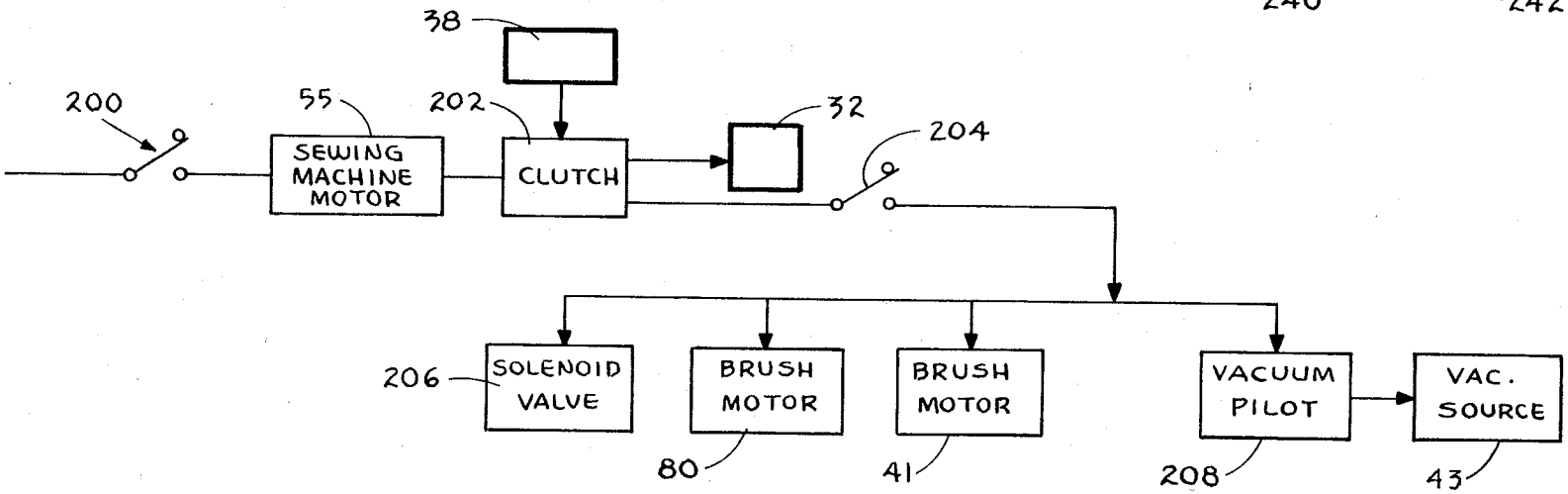
FIG. 10 is a schematic electrical diagram for activating various components of the systems.
Figure 9:
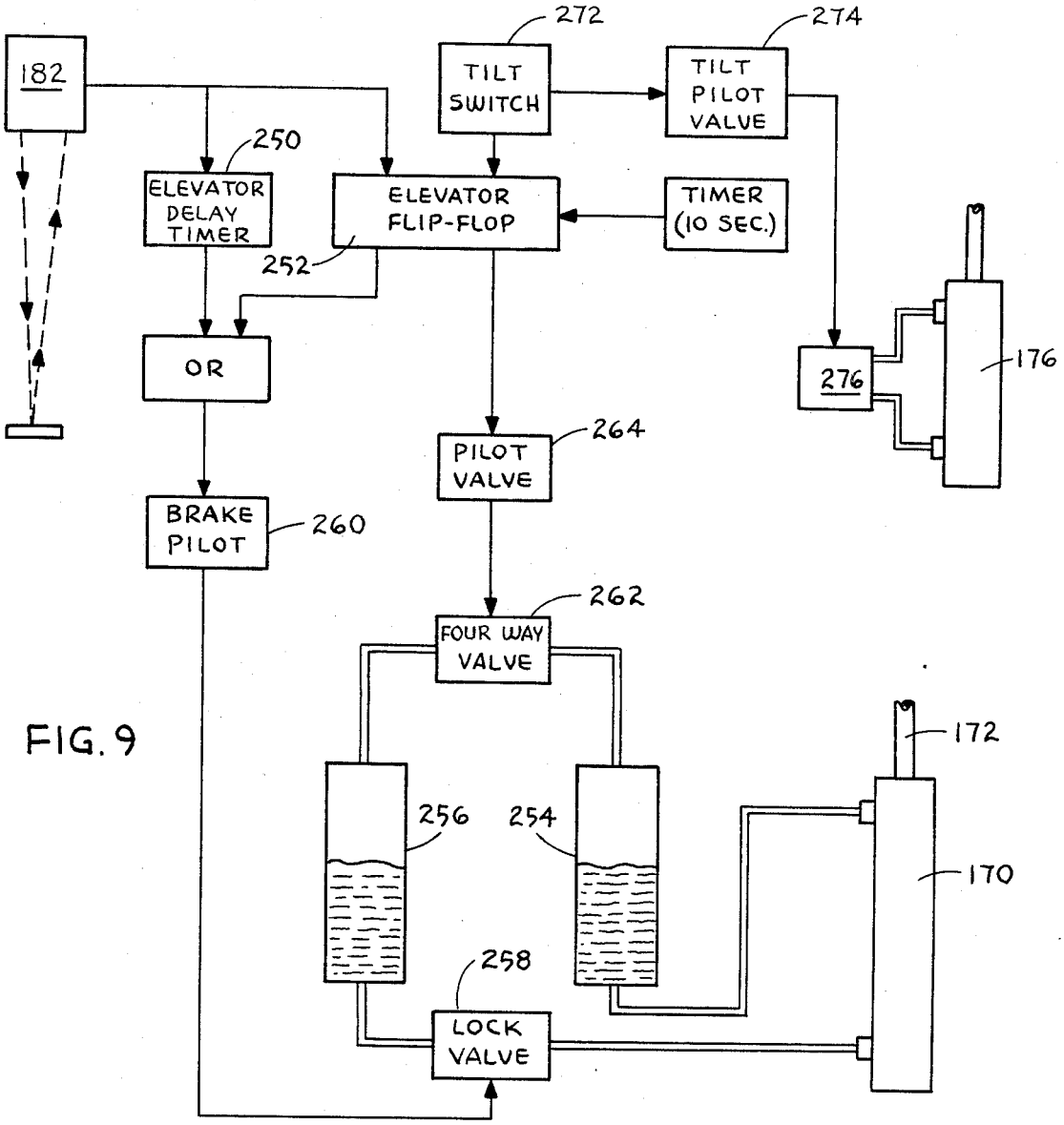
FIG. 9 is a schematic control diagram for the elevator mechanism of the stacking assembly.
Figure 11:
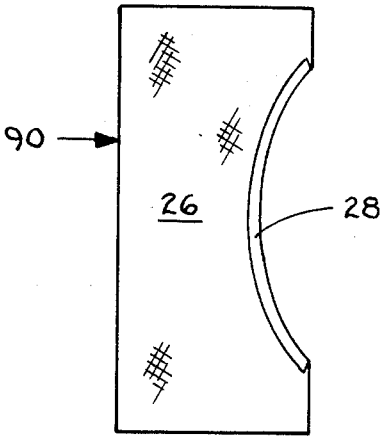
FIG. 11 is a top plan view of a garment component.

The leading edge of the panel 26 is blown aside by the small jet at 42 just as the panel goes under the driven cloth wheel 50 which then holds it aside so that the leading edge is in the proper position to break the light beam directed from light source 61 through opening 60, FIG. 4, in cloth plate 48 and triggers a photoelectric sensor transducer 210 and amplifier 212, FIG. 8. Breaking of the beam initiates several actions. A signal is directed from the amplifier 212 to a waste timer 214 and subsequently to a pilot valve 208 which deactivates the vacuum source 43 so that the panel 26 can pass freely over the opening 46. Suction is normally applied when the beam is unbroken. A signal from amplifier 212 also is directed to a one-shot circuit 218 which sends one pulse through OR circuit 220, lockout timer 222, a toggle action flip-flop circuit 224, and chopper solenoid operated valve 226 which activates chopper cylinder 122 causing an instant chop. The lockout timer 222 is provided to give the chopper time to complete its stroke by serving to block out any of the signals before the chop is completed. The panel 26 attached to binding 28 continues to be conveyed by the cloth brush 44, cloth wheel 50, and binding drive belt 54, and the binding wheel 52 until the leading edge of the panel goes under the conveyor belt 92 which conveys onto the drop plate 152.

When the trailing edge of the panel 26 covers the photoelectric sensor 60 a timer 230 is activated and the vacuum source 43 is reactivated. At this point one of three things happens. The timer may time out and cause the chopper 62 to chop and activate the stacker assembly. The leading edge of the next panel, fed by the operator and also attached to the binding 28, covers the photoelectric sensor and the chopper 62 chops in the same manner as with the first panel. Alternately the timer 230 times out and sends a pulse from one-shot circuit 232 simultaneously to the chopper solenoid operated valve 226 to activate the chopper 62 and to activate the stacker assembly 88. If a subsequent panel 26 follows a preceding panel so closely that the chopper does not have time to complete its cycle before the sensor 60 is again covered, the signal will be ignored and the chopper will not operate. Another possibility is that a subsequent panel 26 covers the sensor 60 before the timer times out. In the event this happens, the pulse or signal from the circuit 218 will cancel the timer causing an instant chop of the binding and activation of the stacker.

To activate the stacker, the pulse from unit 232 starts a timer 234 which through solenoid operated valve 236 causes the fluid cylinder or motor 151 to instantaneously drive the conveyor belt 92 through pulleys 148, 150, drive belt 146 and shaft 144 at a rate of speed which is much greater than the speed that shaft 57 normally drives the belt. This increase in speed is due to the clutches 138 and the one-way clutch of the binding wheel 52 which quickly pulls the component 90 onto the drop plate 152 in a position to be deposited upon the stack tray. When the timer 234 times out the stack conveyor actuator 151 returns to the initial position and timer 234 activates drop plate timer 240, which through solenoid operated valve 242 controls fluid cylinder 160 to tilt and retract the drop plate 152 to the right, FIG. 3, to drop the garment component 90 onto the stack tray 166. When timer 240 times out the fluid cylinder 160 returns the drop plate 152 to its original position. The stacker assembly is now ready to receive the next component 90.

As the stack of components 90 in the tray 166 builds up, the tray is lowered to maintain the top of the stack at a preselected elevation and spaced a predetermined distance below the drop plate 152. The tray 166 is displaceable generally vertically by the double acting air cylinder 170. The air cylinder is controlled by photoelectric sensor 182 (FIG. 7), timer 250, flip-flop circuit 252, valve 262 and air-oil tanks 254, 256. A two-way lock or brake valve 258 is in series with cylinder 170 and between the cylinder and air-oil tank 256. This valve 258, which is controlled by a pilot valve 260, acts as a lock to hold the stack tray 166 in a given position by preventing flow of oil from the lower portion of cylinder 170. The four-way directional valve 262 supplies air pressure selectively to the upper portions of air-oil tanks 254, 256 to power the cylinder 170 either up or down. The valve 262 is controlled by a pilot valve 264 which receives a signal from flip-flop circuit 252.

When the stack tray 166 is at rest, the four-way directional valve 262 is in the down position and the valve 258 is closed. If the beam of the photoelectric sensor 182 is broken, due to the buildup of the stack of components 90, a signal is directed through timer 250 and OR circuit 261 and the valve 258 is opened permitting the tray 166 to move downwardly. When the beam is restored, the valve 258 closes locking the stack tray in position.

To facilitate precise stacking of the components and to prevent inaccurate positioning of the stack tray 166, the tray 166 and stack of components thereon is adjusted periodically. A seek timer 270 times out every ten seconds. If the light beam of sensor 172 is not broken, the two-way valve 258 will open and four-way valve 262 will shift causing the tray 166 and stacked components to move upward towards the beam. When the beam is broken the four-way valve 262 shifts to the down position, and the tray 166 and stack of components 90 will move down until the beam is restored. The valve 258 then closes locking the tray 166 in position.

Figure 3:
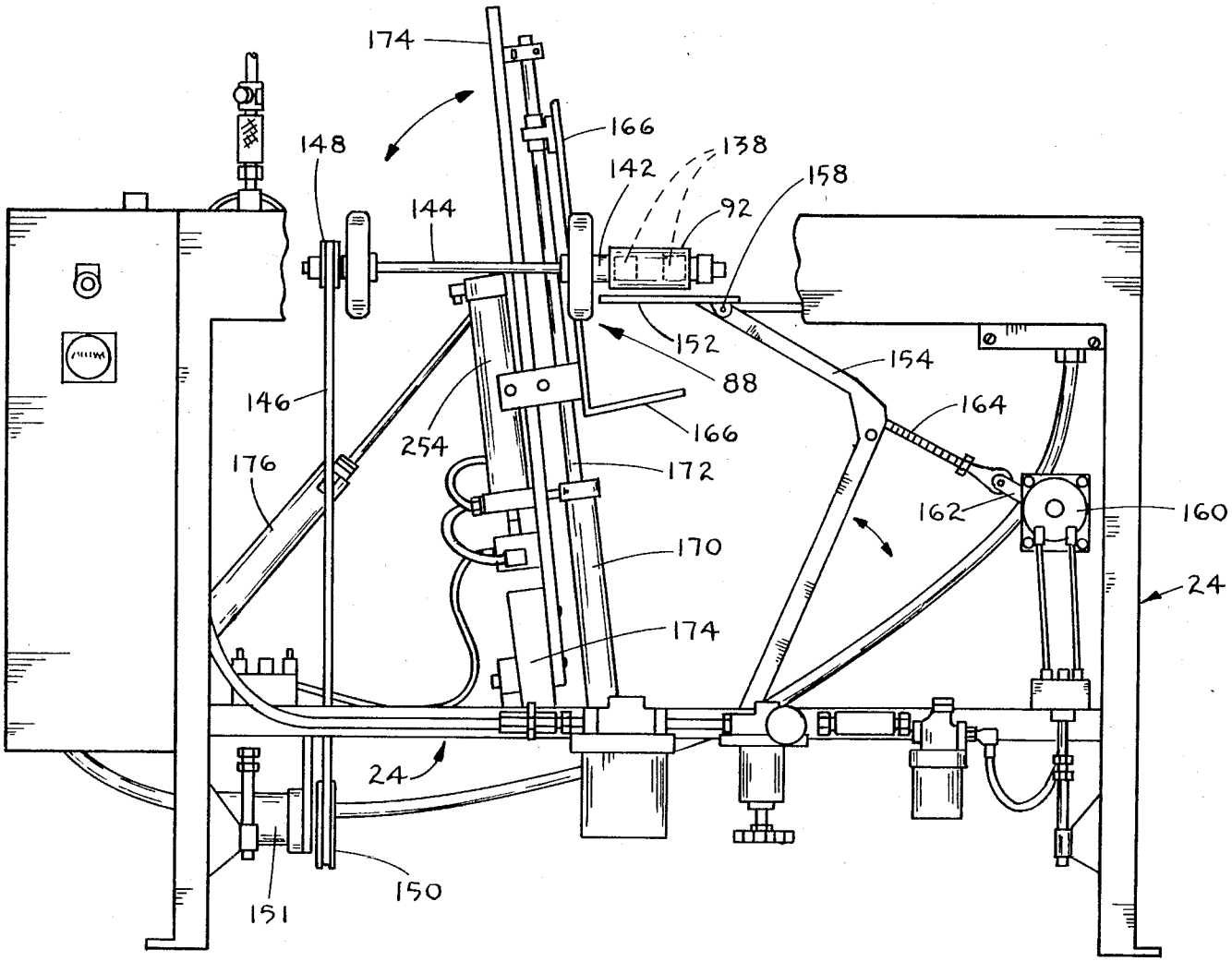
FIG. 3 is a fragmentary, rear elevational view of the apparatus of FIG. 1.

When a predetermined number of panels 26 having binding 28 applied thereto are stacked upon the tray 166, the operator actuates a switch 272 which through pilot valves 274, 264 and four-way valve 262 and valve 276 causes fluid cylinder 176 to tilt the elevator assembly to the left, FIG. 3, and the tray 166 moves to the full up position to assist in unloading of the garment components.

What is claimed is:

1. A system for use in the manufacture of garment components, and the like, in which a plurality of fabric materials are utilized comprising: support means, a machine having sewing instrumentalities mounted upon said support means to sequentially stitch preselected portions of a series of first fabric materials to a second fabric material, means for dispensing said second fabric material from a supply while guiding the second fabric material in a predetermined manner prior to reaching said sewing instrumentalities, chopper means downstream of said sewing instrumentalities for selectively severing portions of said second fabric materials to form discrete garment components, each garment component comprising a first fabric material having selected portions sewn to said second fabric material, said chopper means including angularly disposed blade means traversing said second fabric material for severing simultaneously two portions of said second fabric material, means for feeding said second fabric material to said chopper means and means for vertically stacking said garment components, said stacking means including elevator means for positioning the top of a stack of garment components at a selected position.

2. In an apparatus as recited in claim 1, and further including means for straightening the first fabric materials as they are sewn sequentially to said second fabric material and for flattening and straightening said first fabric materials by urging said first fabric materials in a direction away from said second fabric material.

3. In a system as recited in claim 2, said means for straightening and flattening said first fabric materials including a driven fabric straightener wheel for urging said first fabric materials in a direction away from said second fabric material, and a driven fabric brush having an axis of rotation angularly disposed with respect to the direction of travel of said second fabric material.

4. In a system as recited in claim 1, said chopper means further including blade drive means for displacing said blade means in a vertical plane to sever said second fabric material while maintaining the lower edges of said blade means in a generally horizontal plane, said blade drive means including a fluid cylinder and a linkage for displacing said blade means from a rest position to a cutting position and back to a rest position during movement of said fluid cylinder in one direction.

5. In a system as recited in claim 4, said blade means including a pair of blades, the lower cutting edges of which are angularly disposed relative to each other for simultaneously severing portions of said second fabric material along angularly disposed lines.

6. In a system as recited in claim 1, said stacking means including means for conveying sequentially garment components to a prescribed location, means at said prescribed location for depositing sequentially the garments upon said elevator means, said elevator means including a support tray and means for sensing the top of a plurality of components stacked upon said support tray.

7. In a system as recited in claim 6, said conveying means including an endless belt for engaging and advancing said components, first drive means for normally continuously driving said endless belt at a first speed, and second drive means for instantaneously rotating said endless belt at a second speed substantially greater than said first speed.

8. In a system as recited in claim 7, said elevator means further including timer means for continuously periodically displacing said support tray and components stacked thereon upwardly until said sensing means detects the top of the stack of components upon said support tray.

* * * * *